United States Patent [19]

Valenti

[11] Patent Number: 4,785,610

[45] Date of Patent: Nov. 22, 1988

[54] AUTOMATIC MACHINE FOR PACKAGING PRODUCTS OF DIFFERENT KINDS IN BOXES

[75] Inventor: Dante Valenti, Imola, Italy

[73] Assignee: In-Pak S.p.A., Italy

[21] Appl. No.: 99,346

[22] Filed: Sep. 21, 1987

[30] Foreign Application Priority Data

Sep. 23, 1986 [IT] Italy ..... 3515 A/86

[51] Int. Cl.[4] ..... B65B 5/10; B65B 35/44

[52] U.S. Cl. ..... 53/537; 53/564; 493/131; 493/179

[58] Field of Search ..... 53/535, 537, 558, 564, 53/574; 493/127, 131, 178, 179, 182

[56] References Cited

U.S. PATENT DOCUMENTS

| | | | |
|---|---|---|---|
| 2,753,770 | 7/1956 | Chapman | 493/178 |
| 3,513,757 | 5/1970 | Frank | 493/131 |
| 3,594,977 | 7/1971 | Grasvoll | 53/537 X |
| 3,605,377 | 9/1971 | Sabel | 53/564 X |
| 3,896,607 | 7/1975 | Royal | 493/131 X |
| 4,102,252 | 7/1978 | Reichert | 493/182 X |
| 4,479,345 | 10/1984 | Nord | 53/564 |
| 4,624,653 | 11/1986 | McBride et al. | 493/179 X |

FOREIGN PATENT DOCUMENTS

| | | | |
|---|---|---|---|
| 2363030 | 7/1975 | Fed. Rep. of Germany | 53/535 |

*Primary Examiner*—James F. Coan
*Assistant Examiner*—Steven P. Weihrouch
*Attorney, Agent, or Firm*—Darby & Darby

[57] ABSTRACT

The machine consists of a first flow line which conveys box blanks from feed station to a box-filling station, a second flow line for products, leading to a third station where the products are collated to form groups which are then transferred to the box-filling station where they are inserted into the boxes, and finally a third line which carries the boxes made at this latter station, each boxes containing a group of products, to a fourth station where the boxes are completed.

20 Claims, 6 Drawing Sheets

Fig. 4
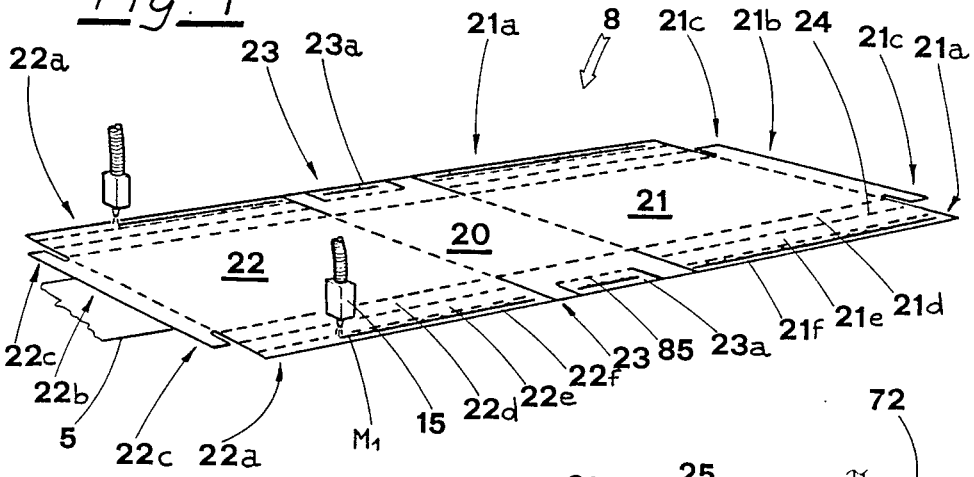
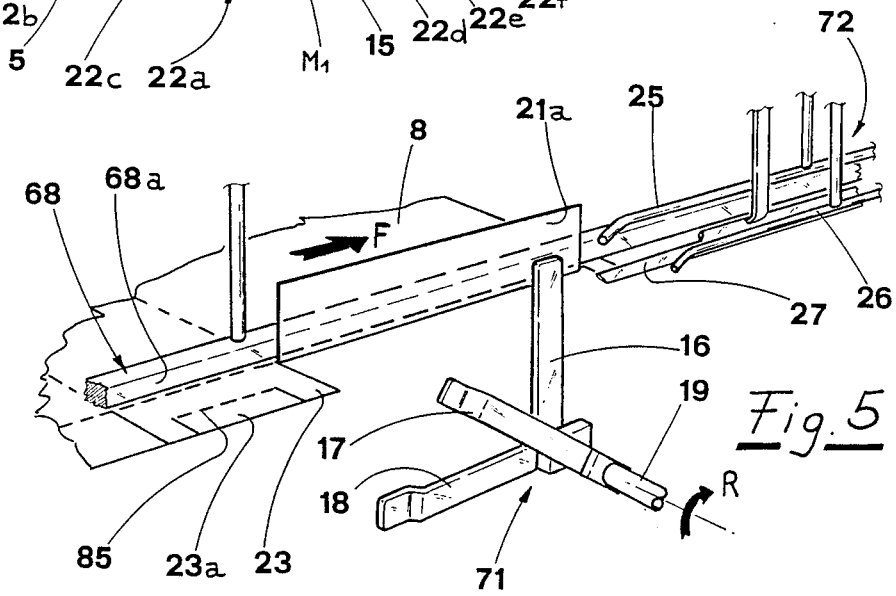
Fig. 5
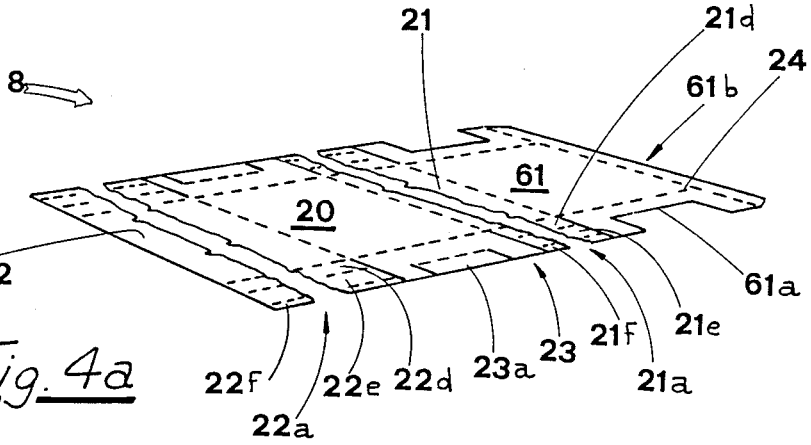
Fig. 4a

Fig. 6
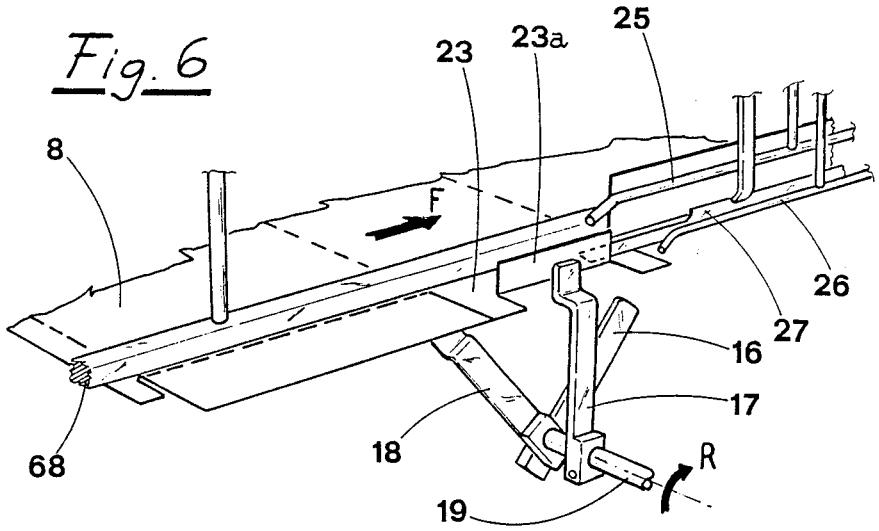
Fig. 7
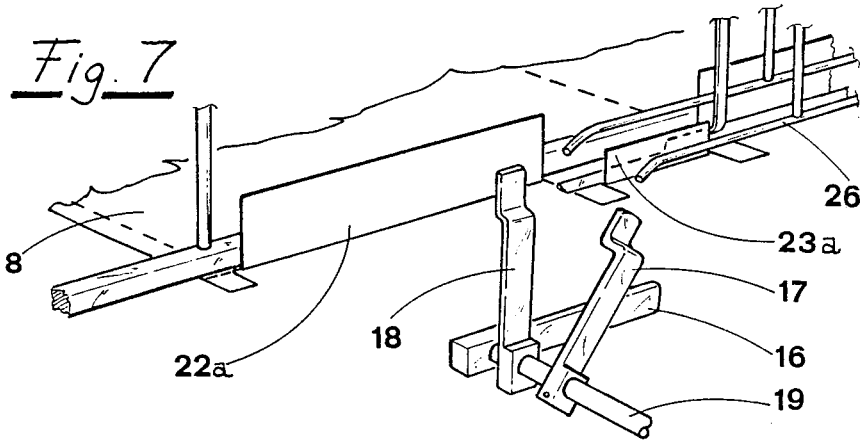
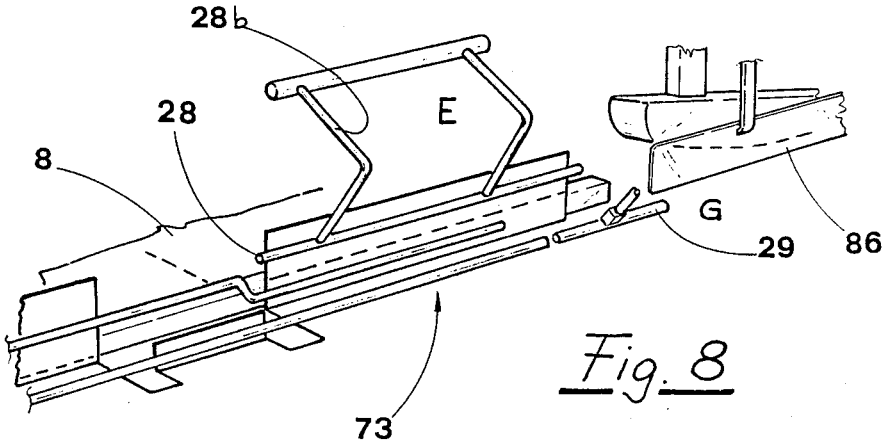
Fig. 8

Fig. 9
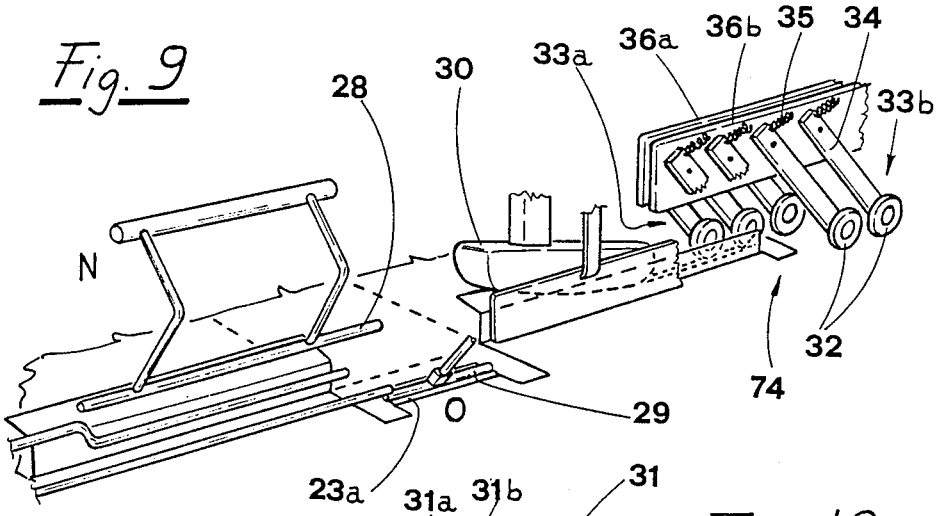
Fig. 10a
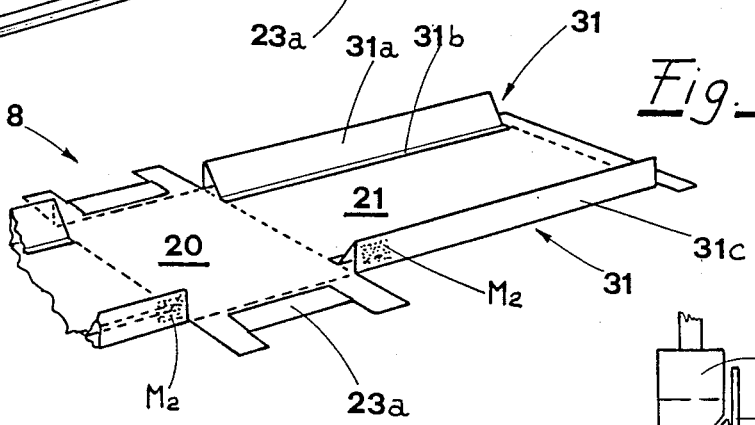
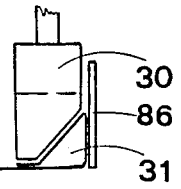
Fig. 11a
Fig. 10b
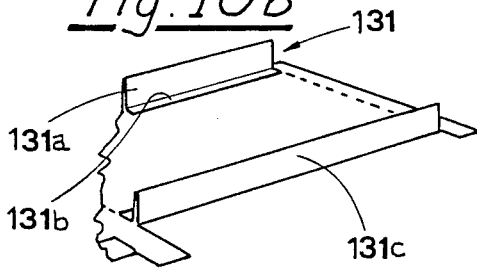
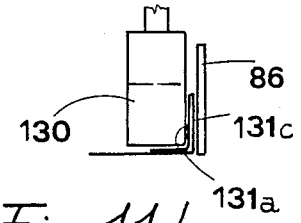
Fig. 11b
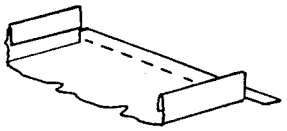
Fig. 10c 54
60
78
4
57
87
31
88
31c
58
7
61a
64
M4
56
63
62
77
59
Y
81
21b
22b
82
83
61
61b
46b
F
45
10
M3
W2
W1
Z1
Z2
III
U
T
V1
V2

AUTOMATIC MACHINE FOR PACKAGING PRODUCTS OF DIFFERENT KINDS IN BOXES

BACKGROUND OF THE INVENTION

The invention relates to an automatic machine that is designed to effect the packaging of products of various kinds in boxes.

DESCRIPTION OF THE PRIOR ART

It is known that products of different kinds, such as containers of cylindrical shape (bottles and cans), or parallelepipedal shape, are usually packaged in cardboard boxes made from a single, appropriately shaped and perforated blank.

In general, the boxes are erected first, either manually or by means of automatic equipment, and then filled with the products.

The filling of the boxes may also be carried out manually or by means of automatic machines. Finally, the boxes are closed, again either manually or by mechanical means.

The main disadvantage of carrying out all or some of the aforementioned operations manually is low productivity and, consequently, high production costs.

As to automated packing, all the machines currently used for this purpose are characterized by extreme constructional complexity, due principally to the fact that the products have to be inserted into pre-erected boxes.

Such complexity means that these automatic packaging machines have high construction and maintenance costs.

It must also be pointed out that the market demand in this field is presently oriented towards the so-called "VISUAL BOX" type of box, which enables the contents of the box to be seen from the outside.

To date, the boxes of the aforementioned kind are erected manually, since it has not so far been possible to overcome the difficulties involved in automating the operation.

SUMMARY OF THE INVENTION

The object of the present invention is to provide an automatic machine that is able to collate the products, erect, from a single blank, the boxes in which the said products are to be packaged, and insert the products into the boxes, carrying out all the said operations by means of mechanical devices that operate dynamically together and that are constructionally simpler and more productive than the automatic machines produced up to the present time.

Another object of the invention is to provide a machine that, besides achieving the object just mentioned, is able to package the products in the aforementioned visual boxes, without this fact negatively influencing its efficiency, reliability and performance.

The object just mentioned is achieved by means of an automatic machine that collates and packages groups of products in boxes, each box being made from a single blank that has slots and preformed fold lines along its length and breadth, the said fold lines defining the central area that will make up the bottom of the box, and delimiting the central area from the outer areas, namely front, rear and side, of the blank, all the said areas being provided with a number of flaps and there being another, small falp on the end of both the front area and the rear area that will make up the front end and back end of the box; the aforementioned machine comprises the following parts: a first station for intermittently feeding the aforesaid blanks into a first flow line, the latter leading into a second, box filling station; first means, operating along the aforementioned first line, downstream of the aforesaid first station, for applying first strips of glue on the edges of the long side of the said flaps that wil be glued to corresponding inner surfaces of the aforementioned blank; second means, located downstream of the said first means, that work in synchrony with the translating motion of the blank and that are designed to fold the aforesaid flaps upwards in sequence; third means, related to the aforementioned first line, for supporting and guiding the said folded flaps; fourth means, that work in synchrony with the translating motion of the blank and that are designed to fold the aforementioned flaps a second time in such a manner as to form strengthening projections in which the said first strips of glue smeared on the long edges of the aforementioned flaps are positioned face-to-face with corresponding surfaces of the blank; fifth means, that are located after the said fourth means and that are designed to press the aforesaid long edges against the aforesaid underlying surfaces of the blank; sixth means that are located after the said fifth means and upstream of the aforementioned box filling station, and that are designed to apply second strips of glue on the inner portions of the long outer faces of the aforementioned strengthening projections; a second line, located at a lower level than the first line, leading to a third, collating station, and designed to convey the products, in equally spaced, parallel rows, to the said collating station; seventh means, that work at the aforesaid second and third stations and that are designed to collate the products at the third station and convey each group of collated products to the second station, located above the aforementioned central area of the blank, the latter having already been conveyed to the same second station by the aforementioned first line; eighth means, that work at the said second station and that are designed to fold upwards the aforesaid front, rear and side areas, the latter areas being pressed against the inner portions of the long sides smeared with the second strips of glue, in such a manner as to make up the sides and ends of a box containing a collated group of products, and that are designed also to position the box on a third, flow line; ninth means for applying third strips of glue on the top edges of the said box; tenth means, that work on the aforesaid third line at a fourth station, and that are designed to fold the aforementioned small flaps against the said top edges smeared with the third strips of glue, in such a manner as to complete the aforementioned box.

BRIEF DESCRIPTION OF THE DRAWINGS

The characteristics of the invention that do not emerge from the above are emphasised hereinafter with specific reference to the attached drawings, in which:

FIGS. 4, 5, 6, 7, 8 and 9 illustrate schematically and sequentially the phases in the formation of the strengthening projections on the blank, as well as the means used to carry out the said phases;

FIG. 4*a* shows a perspective view of a cardboard blank that is shaped in such a manner as to obtain a different kind of box;

FIGS. 10*a*, 10*b* and 10*c* are partial views of three cardboard blanks, showing three different ways in which the strengthening projections can be made;

FIGS. 11*a* and 11*b* illustrate a construction detail of FIG.9, made in two versions, each designed to make the strengthening projections illustrated in FIGS. 10*a*, 10*b* and 10*c;*

DESCRIPTION OF THE PREFERRED EMBODIMENT

Figure 1:
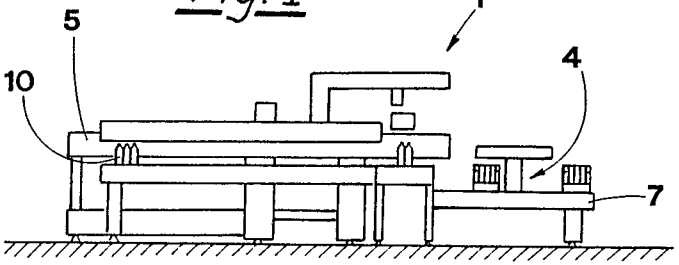
FIGS. 1 and 2 show schematic, small-scale side and plan views, respectively, of the machine concerned in this invention.
Figure 2:
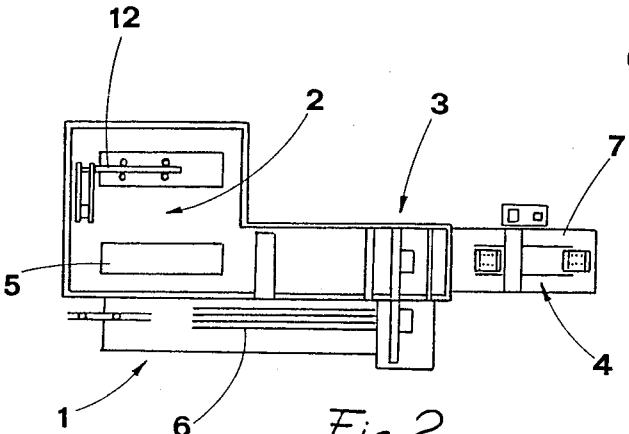

With reference to FIGS. 1 and 2, shows at 1 is an automatic machine for packaging in boxes products of different kinds 10, such as bottles or parallelepipedal containers.

The boxes which the products must be inserted into are of the type made from a single blank 8 (FIG. 4) with slots and fold lines 24 along its length and breadth (shown by broken lines).

Figures 14A, 14B, 14C, 15:
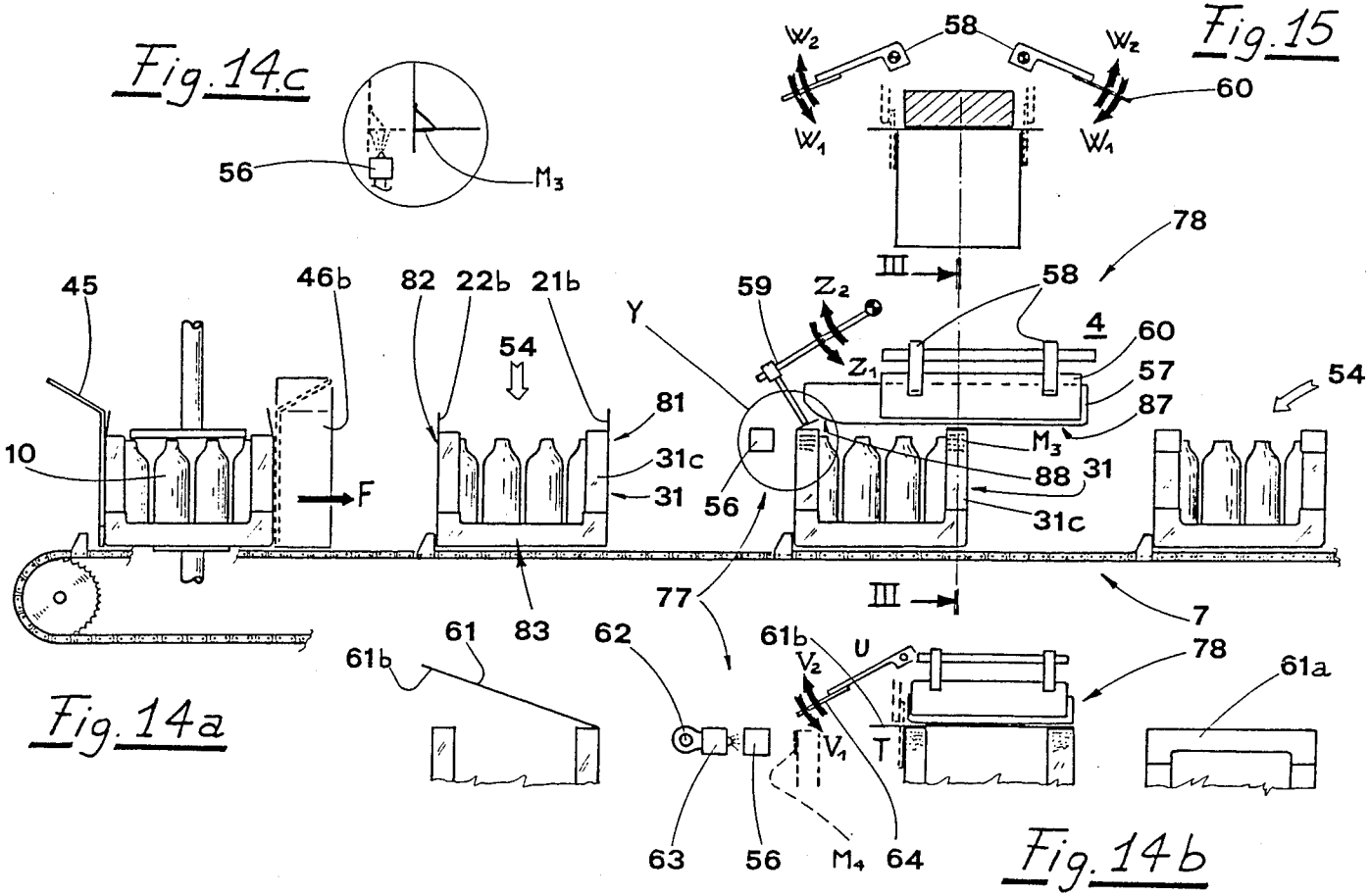
FIG. 14*a* illustrates schematically the second station, the third flow line and the fourth station viewed along the longitudinal section II—II of FIG. 13.
FIG. 14*b* shows a schematic, partial view of the same section as FIG. 14*a* but of another embodiment of the machine for making a different kind of box.
FIG. 15 illustrates schematically a detail of FIG. 14*a* viewed along cross section III—III of FIG. 14*a;*
FIG. 14*c* shows a plan view of detail Y of FIG. 14*a;*

Each blank consists of a central area 20 that will form the bottom of the box 54, and that is attached to a front area 21, a rear area 22, and two side areas 23, that will form the front end 81, the back end 82 and the sides 83 of the box, respectively, as illustrated in FIG. 4 and FIG. 14*a*.

Each side area 23 is provided with a flap 23*a* used for making a horizontal strengthening projection 70, as described hereinafter.

Attached to both sides of each of areas 21 and 22, there are two flaps 21*a* and 22*a*, each of the said flaps being in turn divided by means of longitudinal perforations 24, into three portions, namely inner 21*d* and 22*d*, middle 21*e* and 22*e*, and outer 21*f* and 22*f*.

The latter flaps are designed to form the vertical strengthening projections 31 of the front and back ends of the box.

The free ends of the aforementioned areas 21 and 22 are provided with a limb. In one embodiment of the boxes (FIG. 4), such limbs are edge panels 21*b* and 22*b*, with a tab 21*c* and 22*c* on each end.

The machine has four stations, 2, 3, 80 and 4, namely first, second, third and fourth, respectively, and three lines 5, 6 and 7, namely, first, second and third, respectively, that are described in more detail below.

Figure 3:
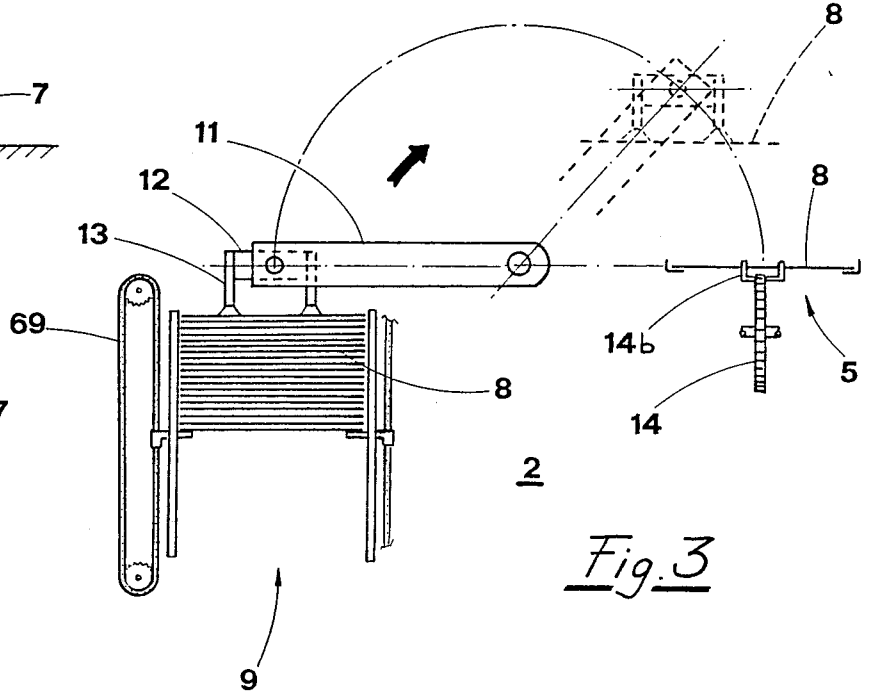
FIG. 3 illustrates schematically the cardboard blank feed station.

FIG. 3 illustrates the first station 2 where there are means for picking up the blanks 8 from a pile of blanks in the magazine 9, the said means consisting of two arms 11 having one end hinged to the structure of the machine and a crosspiece 12 between the two other ends.

The two arms, arranged in such a way that the crosspiece is parallel to the first line 5 and to magazine 9, can swing through an arc of 180 degrees, according to a preset periodic cycle, from a first pickup position, in which crosspiece 12 is over magazine 9, to a second release position, in which the crosspiece is over line 5.

Crosspiece 12 is articulately jointed to arms 11, by known means, in such a manner that the horizontal arrangement is always the same, whatever the position of the arms.

The side of the crosspiece that always faces down is provided with pickup means 13, of a known kind, (for example, suckers connected to a suction device that is not illustrated) that operate in synchrony with the motion of the arms in such a way that the arms pick up a blank 8 when they are in the first position and place the blank on line 5 when they are in the second position.

Magazine 9 includes means 69, of known kind, which raise the pile of blanks 8 by a preset amount (for example, the thickness of one blank) every time a blank is removed.

The blanks are thus picked up and placed on line 5 in synchrony with the flow of products 10 on the second line 6, as described hereinafter.

Below line 5 are located means 14, of known type (for example, a motor-driven chain with equidistant links and related fork 14*b*, to feed the blanks 8 along line 5 in direction F.

The steps in the formation of the strengthing projections 31 and 70 and the means that carry out such steps are described below with reference to FIGS. 4, 5, 6, 7 and 8.

For clarity, in relation to the said illustrations, only one side of the machine is described below since the two sides of the machine are made up of identical means arranged symmetrically.

A glue feeder 15, fixed to machine 1 at a point above the first line 5, smears a first strip of glue M1 on the aforementioned outer portions 21*f* and 22*f* and on the aforementioned flaps 23*a*.

Downstream of feeder 15, below line 5, there is a shaft 19, that is set transversely in relation to line 5 and that is rotated in direction R by means of a known kind (not illustrated), in synchrony with the means that feed the cardboard blank.

On the end of the shaft that projects from the side of line 5, there are keyed three folder amrs 16, 18 and 17, namely, first, second and third, respectively, arranged like an open fan.

The free ends of the first and second folder arms move in the same circumference, and respectively precede and follow the free end of the third folder arm, in accordance with the direction of rotation of shaft 19, the said third arm moving in a circumference that is equal in diameter to the outer circumference, but positioned further out.

Above line 5, at the points where arms 16 and 18 are situated, there is a bar 68, parallel to the axis of line 5, and arranged in such a manner that the fold lines delimiting flaps 21*a* and 22*a* of a blank passing under the bar are positioned at the outer vertical face 68*a* of the bar.

During the rotation of shaft 19 and the translating motion of the blank, the free end of arm 16 intercepts flap 21*a* and folds it upwards (FIG. 5), operating together with bar 68, which constitutes a stop for the blank.

Subsequently, as a result of the movement of blank 8 in direction F, the folded flap reaches a first support 25, that is located downstream of the arm assembly, and that maintains the vertical arrangement, while the shaft rotates until arm 17 intercepts flap 23*a* (FIG. 6) of the blank's related side area 23, which contemporaneously reaches the same shaft.

Flap 23*a* is thus folded upward (at a fold line 85 defined by a perforated line) by arm 17 working in conjunction with a pad 27, related to the machine's structure above line 5, that is designed to hold down part of the flap and thus prevent the entire flap from folding.

Blank 8 continues moving forward in synhrony with the rotation of shaft 19, in such a manner that arm 18 of the shaft strikes flap 22*a* and causes it to fold upward, while flap 23*a* is maintained in vertical position by a second support 26 (FIG. 7) arranged parallelly to the first support 25.

Proceeding in the direction of feed of blank 8, there is a movable bar attached to related supports 28*b* which are hinged to the structure of the machine. The movable bar is made to swing by known means (not illustrated) in trajectories contained in planes that are perpendicular to line 5, from an outer position E to an inner position N and vice versa.

When flap 21*a* and flap 22*a*, each in turn, reach bar 28, the bar is rotated from position E to position N (as illustrated in FIGS. 8 and 9), thus folding inwards the middle portion 21*e* and the outer portion 21*f* of the said flaps.

Downstream of bar 28, there is a metal segment 29, located on one side of line 5 and parallel to the latter. The bar is driven by known means (for example, a pneumatic jack) in such a way that it is able to move obliquely in relation to the plane of the same line from an outer position G to an inner position O, and vice versa.

When flap 23*a* (smeared with the strip of glue M1) reaches segment 29, the latter moves from position G to position O, thus striking the flap and pressing it against the corresponding surface of area 23. Flap 23*a* sticks to area 23 and forms a horizontal strengthening projection 70 (Figs. 8 and 9).

The two middle portions 21*e* and 22*e* and outer portions 21*f* and 22*f* of flaps 21*a* and 22*a* folded by bar 28, then move under a block 30, that is attached to the structure of the machine and located above the first line.

As the blank moves forward in direction F, the cross section profile of the block gradually changes in shape from rectangle to right-angled trapezium, with the small base facing down and the oblique side facing the outer side of the line (FIG. 11*a*).

The distance between the lower side of block 30 and the underlying plane of line 5 gradually decreases in accordance with direction F, until a preset value is reached (for example, twice the thickness of blank).

A vertical longitudinal plate 86, located near and parallel to the side of the block that faces the outer side of the line, constitutes a stop for the inner longitudinal portions 21*d* and 22*e* of flaps 21*a* and 22*a*.

The two middle portions 21*e* and 22*e* and outer portions 21*f* and 22*f* of flaps 21*a* and 22*a* are therefore folded along a longitudinal fold line 24 according to a profile that is complementary to the lower surface of the block, in such a manner as to make oblique sections 31*a* and horizontal sections 31*b* (FIG. 10*a*); on account of the strips of glue M1 previously applied to the outer portions 21*f* and 22*f*, the horizontal sections 31*b* adhere to the corresponding inner surfaces of of areas 21 and 22.

The inner portions 21*d* and 22*d*, arranged vertically, make vertical sections 31*c*, which, together with the oblique sections 31*a* and horizontal sections 31*b*, form vertical strengthening projections 31.

Located after the block, there are two rows 33*a* and 33*b* of pressure rollers 32, both parallel to the axis of the first line 5.

Each roller is rotatably supported by a lever 34, subject to the action of elastic means (for example, springs).

The levers of each of the two rows 33*a* and 33*b* are hinged to plates 36*a* and 36*b*, respectively. The latter plates are arranged above the first line 5 in such a manner that the rows of rollers 33*a* and 33*b* move into the trajectories described, during the movement of the blank along the first line, by the outer portions 21*f* and 22*f*, defining the horizontal sections 31*b* of strengthening projections 31, and by the folded flap 23*a*, respectively.

When the blank reaches rows 33*a* and 33*b*, row 33*a* exerts a compressing action on portion 31*b* of strengthening projection 31, while the outer row, 33*b*, compresses the folded flap 23*a* of area 23. The system just described improved the adhering action of the glue applied along strips M1.

Figure 13:
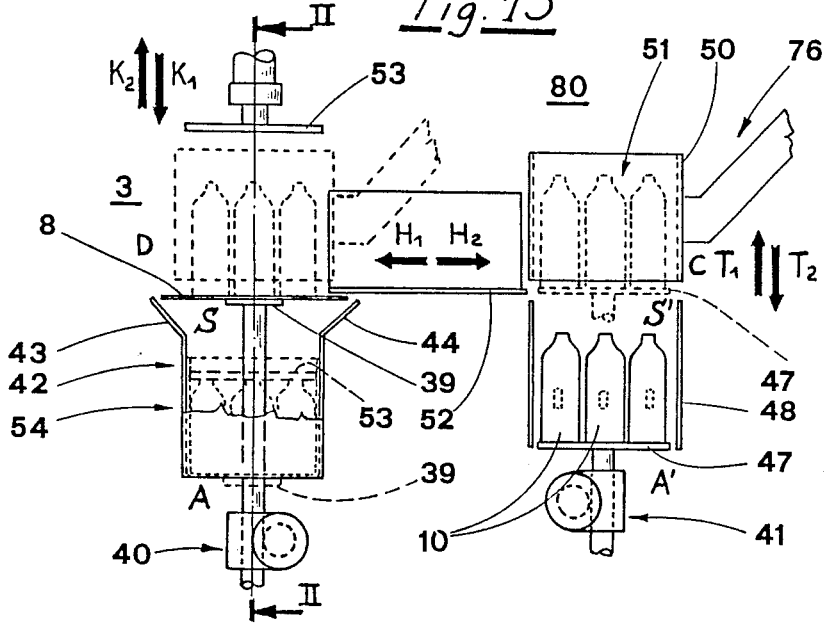
FIG. 13 shows schematically the same, second and third stations in cross section, namely, section I—I of FIG. 12.
Figure 12:
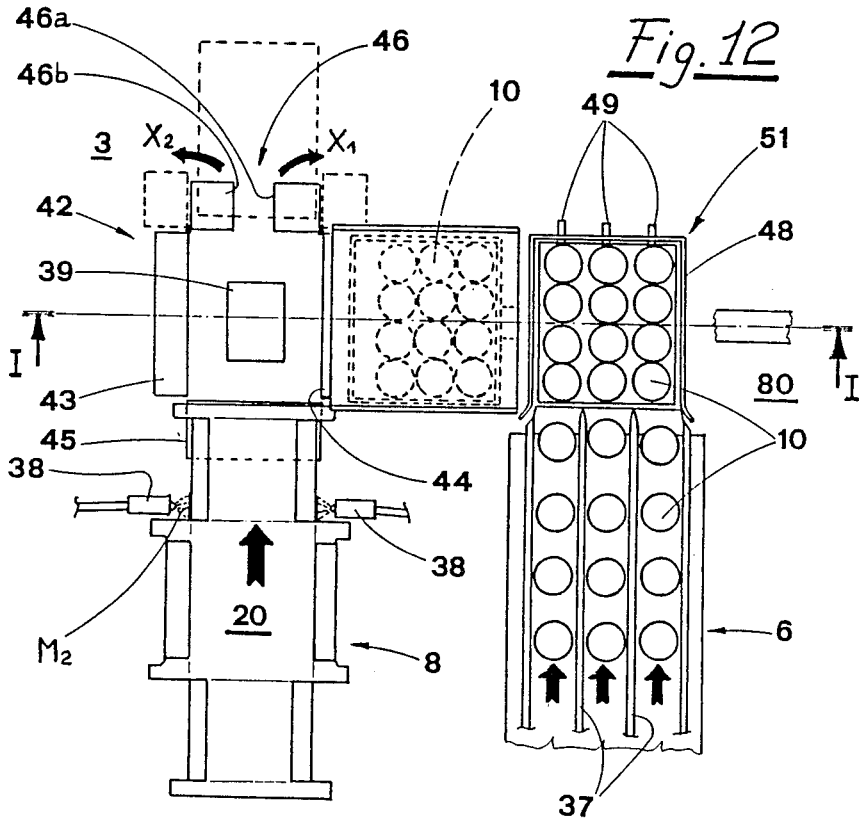
FIG. 12 shows a schematic plan view of the second, box-filling station and the third, product collating station.

Downstream of the means described above, there is located a second, box filling station 3, working together with a third station 80, where the products 10 conveyed to it by a second line 6 are collated. Stations 3 and 80, both illustrated in Figs.12 and 13, are made up of the means described hereunder.

At the infeed end of station 3, there are other glue feeders 38, located on either side of the end section of line 5, which, as the blanks move towards the second station 3, smear seconds trips of glue M2 on the base of the outer faces of the vertical sections 31c of the vertical strengthening projections 31.

Each blank 8 is then set with its central area 20 on a plate 39. Related to plate 39 are means 40, of known type, (for example, a pneumatic jack) which move the plate up and down in opposite directions K1 and K2 from a raised position S, at which the plate is co-planar with the first line 5, to a lowered position A, at which the plate is co-planar with a third flow line 7 which starts at the second station, at a level below line 5 and under the plate.

Above plate 39 there is a pushing device 53, which is driven by means of known type (for example, an electric motor) in the aforementioned opposite directions K1 and K2 and the function of which is described below.

At the third, collating station, products 10 are conveyed in parallel rows from the second line 6 into a collector 48, which is open to the second line at the top, bottom and side.

Platform 47, works at the opening at the bottom of the collector, moving up and down in directions T1 and T2, from a lowered position A1, at which it is co-planar with the second line, to a raised position S1, at which it is co-planar with the central area 20 of the blank 8 on the plate.

The platform is driven by known means 41 (for example, an electric motor).

The side of the collector opposite the second line 6 mounts means of detection 49, of known kind, which detect the presence of the rows of products inside the collector.

A basket 50, equal in perimeter to collector 48 and driven by known means (not illustrated), moves in opposite direction H1 and H2 between a first position C, at which it is over collector 48 and coaxial to the latter, and a second position D, at which is over plate 39.

When collector 48 has a complete collated group 51 of products 10 in it, the platform moves to its raised position S1, inserting the products into the basket above it.

The basket then moves from the first to the second position D, dragging the products along a fixed board 52 whose surface enables the platform in raised position S1 to be connected to the central area of the blank resting on the plate.

The group of products 51 is thus placed above the central area 20.

Plate 49 then moves to its lowered position A, in direction K1 and in synchrony with the pushing device.

As the plate moves, front area 21, rear area 22 and side areas 23 are intercepted by the walls 43, 44, 45 and 46 of a hopper located half way between positions A and S on plate 39. The hopper is especially shaped to enable the plate and the pushing device to move through it.

The front, rear and side areas of the blank are thus folded upwards by the combined action of the pushing device on the group of products 51 and of the hopper walls on the aforementioned areas of the blank.

The front and rear areas of the blank, that is, the front end 81 and the back end 82 of the box being erected 54, are folded first so that the side areas 23, constituting the sides 83 of the box, can stick to glue strips M2 on the base of the strengthening projections 31.

When the plate is in its lowered position A, the box is located above the third line and the pushing device moves in direction K2 back to reset position. Basket 50 is therefore able to move in direction H2 back to the first position to receive another group of products.

The three hopper walls 43, 44 and 45 are fixed, whereas the fourth wall 46, which faces the direction of flow of the third line, is made up of two leaves **46*a* and 46*b*** which rotate in opposite directions X1 and X2, symmetrically, so as to open the hopper laterally.

When the pushing device has completed its return stroke, hopper wall 46 opens and allows the third line 7 to extract box 54 from hopper 42 and to convey it towards the fourth station 4.

The means that work at the fourth station 4 are described below with reference to FIGS. **14*a* and 15**.

These means include two glue feeders 56, arranged on two sides above line 7 at a level corresponding to the trajectories described by the tops of sections **31*c* of strengthening projections 31**.

The said glue feeders are activated by box 54 as it moves past them and third glue strips M3 are thus smeared on the aforesaid tops. Edge panel **21*b*, on the front end of the box 81, is then intercepted by the curved surface 88 of a guide 57, located above the third line 7**.

Curved surface 88 has a gradual downward slope in the direction of box flow F, in such a manner that edge panel **21*b*** is folded above the top ends of the related strengthening projections.

A flat surface 87, defined by the bottom face of the guide, is parallel to the horizontal plane made by the third line 7 and comes after the curved surface 88, so as to keep the edge panel that is inserted under it folded.

Hinged to the structure of the machine, above line 7, there is a folder arm 59, which is driven by means of a known kind (not illustrated). When edge panel **22*b* of the back end comes near to guide 57, the arm swings in direction Z1, that is the same as the direction of flow of the boxes, in such a way that the free end of the arm strikes edge panel 22*b***.

Edge panel **22*b* is thus folded over the top ends of the strengthening projections 31 and can be inserted correctly first under curved surface 88 and then under the flat surface 87 of guide 57**.

Arm 59 then swings in direction Z2, opposite to direction Z1, back to the starting position.

On each side of guide 57 there is a wing plate 60 hinged to the structure of the machine by means of two links 58.

Wing plates 60 are driven by means of a known kind (not illustrated) and swing in opposite directions following trajectories contained in planes perpendicular to the third line.

When there is a box under guide 57, wing plates 60 swing closed in direction W1, in such a manner as to fold downwards the two tabs **21*c* and 22*c* of edge panels 21*a* and 22*a* and to make the said tabs stick to the corresponding surfaces of sections 31*c* of strengthening projections 31, which are smeared with third strips of glue M3. Wing plates 60 then swing open in direction W2, opposite to W1, and the finished box, full of products, is conveyed outside machine 1 on line 7**.

In another embodiment of the invention, the machine described above makes it possible to use another type of box, made from a blank shaped as illustrated in FIG. **4*a***.

In this case, the aforementioned limbs are constituited by an added side area 61, attached to front areas 21, with an added side area **61*a* on either side of the added area 61**.

On the free end of added area 61, which will form the box lid, there is an edge panel 61b used for closing the lid. In this embodiment, the means for applying the glue consist not only of glue feeders 56 but also of a slide 62, which is moved in synchrony back and forth in a direction perpendicular to line 7, by known means (not illustrated), the said slide being provided with a glue feeder 63 that moves in a trajectory at a level corresponding to the top of the back end 82 of boxes 54.

When a box passes, the slide crosses the third line and glue feeder 63 applies a fourth strip of glue M4 along the top outer edge of the rear end 82 of box 54. Instead of arm 59, there is a third wing plate 64 that swings from a raised position U to a lowered position T, in opposite directions V1 and V2, that are, respectively, the same as and opposite to the direction of flow F of the boxes.

The folding of the added area 61, which will form the lid of box 54, is effected by curved surface 88 of guide 57.

When box 54 is under guide 57, whose flat surface 87 presses lid 61 against the tops of strengthening projections 31, wing plates 60 swing closed so as to fold the added side areas **61*a*, and, at the same time, the third wing plate 64 moves to lowered position T, thus folding edge panel 61*b*** downwards and causing it to adhere to the back end that is smeared with the fourth glue strip M4.

The third wing plate 64 when moves back to raised position U and wing plates 60 swing open again.

In another embodiment of the invention, the strengthening projections 131 can be made as illustrated in FIGS. **10*b* and 10*c*, with sections 31*a* and 131*c* mutually touching and without the third portion 131*b***, respectively.

The variation in this embodiment involves block 130, which has the shape of a rectangle which becomes gradually longer downwards, in the direction of flow F of blank 8.

In addition, the gap between the block and its related longitudinal plate is equal to twice the thickness of the flaps of the aforementioned blank, and it is into this gap that sections 131*a* and 131*c* slide.

The machine described above packages products 10 in boxes 54 which, in all the embodiments described, enable the most important parts of the products they contain, namely the parts with the manufacturers' brand name, to be seen from the outside; in short, the aforementioned machine makes packages using boxes of the type known as "VISUAL BOX".

From the above description, it is clear that the machine is functional and high-performing, although it has no particularly complex parts. The machine's high output is due also to the fact that boxes 54 are erected and filled with products contemporaneously.

This has two main advantages. Firstly, it enables a notable reduction of the machine's overall construction cost and, secondly, it makes the machine much easier and, consequently, more economical, to maintain.

In addition, the machine is highly versatile since all the parts that make it up are easy to adjust in relation to each other: Thus, for example, arms 16, 17 and 18 can slide along shaft 19 and plates 36*a* and 36*b* can be adjusted independently of one another in a direction perpendicular to line 2, in such a way as to operate on different sections of the blank 8.

What is claimed is:

1. An automatic machine for packaging products of different kinds in boxes, said products being insertable in groups into said boxes, each box being made from a single blank having slots and preformed fold lines along its length and breadth, said fold lines defining a central area that forms the bottom of said box, and delimiting said central area from outer areas, including a front area, a rear area and side areas, respectively, of said blank, all said outer areas being provided with a number of flaps and there being a limb on an end of both said front area and rear area that provides a front end and a back end of said box; the machine comprising: a first station for intermittently feeding the blanks into a first flow line, leading into a second, box-filling station; first means, operating along said first line, downstream of said first station, for applying first strips of glue on the edges of the long side of said flaps for gluing to corresponding inner surfaces of said blank; second means, located downstream of said first means, that work in synchrony with translating motion of said blank for folding the glued flaps upwards in sequence; third means, located downstream of said second means, for supporting and guiding said folded flaps; fourth means, that work in synchrony with translating motion of said blank for folding said flaps a second time to form strengthening projections in which said first strips of glue smeared on said long edges of said flaps are positioned face-to-face with corresponding surfaces of said blank; fifth means, that are located after said fourth means for pressing said long edges against said corresponding surfaces of said blank; sixth means that are located after said fifth means and upstream of the box-filling station, for applying second strips of glue on inner portions of long outer faces of said strengthening projections; a second line, located at a lower level than said first line, leading to a third, collating station, for conveying said products, in equally spaced, parallel rows, to said collating station; seventh means, for collating said products at said third station in order to form groups of said products and to convey each said group to the second station, located above said central area of the blank, the blank having already been conveyed to the same second station by the first line; eighth means, located at said second station, for folding upwards said front, rear and side areas, which are pressed against said inner portions of the long sides smeared with said second strips of glue, to make up sides and said ends of said box, with the box containing one of said collated groups of products, the eighth means positioning said box on a third, flow line; ninth means for applying third strips of glue on top edges of said box; and, tenth means, for folding said limbs against said top edges smeared with said third strips of glue, for completing said box.

2. A machine according to claim 1, wherein said second means include: two fixed bars, located above said first line, that serve as a guide for said blank moving under them, that are parallel to the axis of the same line and that are arranged in such a manner that their outer vertical faces are flush with said longitudinal fold lines delimiting said flaps associated to said front and rear areas; at least two first folder arms, and at least two second folder arms that rotate about axes perpendicular to said first line in such a way as to intercept said flaps on both sides of said front and rear areas, thus folding said flaps until they stop against said outer vertical faces of said fixed bars; at least two fixed pads, located on both sides of said fixed bars, flush with corresponding vertical planes made by outer said fold lines related to said flaps of the side areas of the blank; at least two third folder arms, that rotate about an axis perpendicular to said first line in such a manner as to intercept these latter flaps, acting in combination with the said pads to fold the flaps vertically.

3. A machine according to claim 2, wherein said folder arms are keyed at one end to a shaft that is arranged perpendicularly to, and at a lower level than, said first line, said folder arms being arranged in two groups of three, one at each end of said shaft, each group of three forming an open fan shape and being made up of a first, a second and a third folder arm, said third folder arm being set in between said first and second folder arms; said shaft being rotated in synchrony with the translating motion of the aforementioned blank, in such a manner that free ends of said first and second folder arms, moving in the same circumference, intercept said flaps of said front and rear areas, respectively before and after said third folder arm intercepts said flap of the corresponding said side area.

4. A machine according to claim 1, wherein said first station includes: at least two arms hinged at one end to the structure of said machine; a crosspiece articulately jointed to the other end of the aforementioned arms by means that keep said crosspiece horizontal all the time; pickup means located on the bottom face of said crosspiece; means for swinging said arms, in accordance with trajectories contained in planes perpendicular to said first line, from a first position at which the crosspiece is positioned above a magazine containing a pile of blanks, to a second position at which said crosspiece is located immediately above the initial section of said first line; said pickup means, which are turned on and off in synchrony with the swining of said arms, serving to pick up said blank from the top of said pile ad dropping it onto said first line.

5. A machine according to claim 4, wherein said pickup means consist of a number of suckers. connected to a 6. A machine according to claim 4, wherein said magazine includes means for raising said pile of said blanks by a predetermined amount.

7. A machine according to claim 1, wherein said first line includes a drive chain provided with equidistant links and related forks, attached to some of said links, for carrying a corresponding said blank.

8. A machine according to claim 1, wherein said third means include: at least two first fixed supports, arranged longitudinally above said first line and parallelly to the latter, for supporting said flaps of said front and rear areas once said flaps have been folded vertically; two second fixed supports, also arranged longitudinally, located on both sides of said first supports and equidistant from the axis of said first line, said second supports being designed to support corresponding said flaps of said side areas once said flaps have been folded vertically.

9. A machine according to claim 1, wherein said fourth means include: at least two movable bars, parallel to the axis of said first line, mounted on supports hinged to the structure of said machine, said bars working above the aforementioned first line in trajectories contained in planes perpendicualr to said axis of said line, and said bars being made to rotate in opposite directions from an outer position to an inner position, in such a manner as to intercept both long middle portions and outer portions of said flaps related to the aforementioned front and rear areas, thus folding said portions horizontally; two fixed blocks, located immediately above said first line downstream of the respective movable bars, said blocks operating in combination with two vertical longitudinal plates, located on either side of said blocks, in such a manner as to form a guide for inner longitudinal portions of said flaps, thus said blocks intercepting said middle and outer longitudinal portions, which are already folded horizontally, and consequently folding the aforesaid middle and outer portions according to a predetermined profile, in such a way as to complete said aforementioned strengthening projections; at least two movable segments located on either side of said first line and parallel to the latter, each segment moving back and forth in an oblique direction, in relation to said line, from an outer position to an inner position, in such a way as to intercept said flap of the corresponding side area, thus folding said flap.

10. A machine according to claim 9, wherein, as said blank moves forward, the cross section profile of said block gradually changes in shape from rectangle to rightangled trapezium, with the small base facing down and being parallel to said first line, and the oblique side facing outer side of said first line, thus forming a tubular strengthening projection with a triangular cross section.

11. A machine according to claim 9, wherein the cross section of each said block has the shape of a rectangle which becomes gradually longer downwards, in the direction of flow of said blank, said block having the horizontal side parallel to said first line and the vertical side facing said corresponding longitudinal plate with a gap between it and said longitudinal plate that is equal to twice the thickness of said flaps of said blank.

12. A machine according to claim 1, wherein said fifth means include: two parallel rows of pressure rollers, symmetrical about the axis of said first line, and designed to exert a compressing action on corresponding longitudinal portions of said front and rear areas; two other parallel rows of pressure rollers, symmetrical about said axis of said first line but further out than the previous two rows, and designed to exert a compressing action on corresponding flaps of said side areas.

13. A machine according to claim 12, wherein each said row of rollers is associated to a corresponding supporting plate, each said roller of each said row being rotatably supported by a free end of a related lever that is hinged to a respective supporting plate and subject to the action of elastic means.

14. A machine according to claim 1, wherein said first means consist of at least two glue feeders, arranged above said first line, each one along a corresponding trajectory of outer longitudinal edges of said flaps of said front and rear areas, as well as of said flaps of said side areas.

15. A machine according to claim 1, wherein said sixth means consist of at least two glue feeders, arranged on either side of said first line, and at a height above said first line corresponding to a trajectory described by said strengthening projections.

16. A machine according to claim 1, wherein said seventh means include: a plate that moves up and down from a lowered position at which it is co-planar with said third line, and a raised position at which it is coplanar with said first line, in such a manner as to form a support for said central area of said blank, said blank being conveyed on such support in sincrony with means that drive said plate; a fixed collector, located at said second, product collating station, open at the top and bottom as well as open at the side toward said second line; a platform that moves up and down through said collector from a lowered position, at which it is at the same level as the same level as said second line in such a way as to form a bottom of said collector, and a raised position, at which it is at a level at least as high as the brim of said collector, the raising of said platform being subordinated to the collation of a group of products within said collector; a fixed board whose surface enables said platform in said raised position to be connected to said central area of said blank resting on said plate; a basket that moves back and forth in synchrony with said platform and with said eighth means between two extreme positions, first and second, at which it is coaxial with said collector and said plate, respectively, and is positioned at a level that is dynamically at least as high as said fixed board, said basket being designed, when it is at said first position, to receive from said platform said group of collated products, and, with the aid of said platform and board, to transfer said group onto said central area of said blank.

17. A machine according to claim 16, wherein said eighth means include: a pushing device, located above said plate, that moves up and down in synchrony with said plate and in opposite directions; a hopper, that is located at a level half way between the aforementioned first line and third line, that is especially shaped to enable said plate and pushing device to move through it, and that consists of three fixed walls and a fourth wall facing said third line and made up of two leaves which are arranged symmetrically about a vertical plane and which rotate about a point of connection with the contiguous said walls, in opposite directions in such a manner as to open said fourth hopper wall; said plate and said pushing device being designed to move in downward direction from a raised position to a lowered position when said group of products is placed on said central area, in such a way that said four walls of said hopper intercept and fold said front, rear and side areas, and thus completing a box containing said group of products; the re-lifting of said plate and pushing device being subordinated to opening of said leaves and subsequent unloading of said box from said hopper onto said third line by driving means which said third line is provided with.

18. A machine according to claim 14, wherein said collector mounts, on side opposite said second line, a number of sensors for detecting the presence of rows of products with a sensor for each row.

19. A machine according to claim 1 designed for use with said blanks wherein said limbs consist of at least two edge panels that are arranged transversely in relation to said front area and rear area, respectively, and that have on each end a tab and wherein said ninth means consist of at least two glue feeders arranged above, and on each side of, said third line, in such a manner as to apply said third strips of glue on said top edges of said vertical strengthening projections of said box with said tenth means including: a fixed guide located above said third line, constituted by a flat horizontal surface connected uninterruptedly to a curved surface, in the initial section of said guide, the concave surface of the curvature facing up and gradually sloping downwards in the direction of flow of said boxes below it, said curved surface being designed to intercept said edge panel of said box's front end defined by said front area of said blank, in such a manner as to gradually fold said edge panel onto the tops of said strengthening projections, until the fold is completed by said horizontal surface; a folder arm, that is hinged to the structure of said machine above said third line, that swings, in synchrony with the translating motion of said boxes, in opposite directions, a first direction being the same as the direction of flow of said boxes and a second direction being opposite to this, a free end of said arm being designed to strike said edge panel of said box's back end defined by said rear area of said blank, thus folding said edge panel onto said tops of said corresponding vertical strengthening projections, in such a way as to enable said edge panel to be inserted under said curved surface of said guide; two longitudinal winged plates, hinged said machine on either side of said guide, said winged plates rotating in opposite directions following trajectories contained in planes perpendicular to said third line, in closing direction, when said box is under said guide, in such a way as to fold downwards said tabs of said edge panel, causing said tabs to stick to corresponding top edges of said vertical strengthening projections smeared with said third glue strips, and subsequently in opening direction.

20. A machine according to claim 1 designed for use with blanks wherein the aforementioned limbs consist of at least one added area that is arranged transversely in relation to said front area and that has one added side areas on each side and an edge panel on its end; said ninth means consisting of at least two glue feeders arranged above, and on each side of, said third line in such a manner as to apply said third strips of glue on top edges of said vertical strengthening projections of said box, and of a slide moved back and forth in synchrony with the translating motion of said boxes in opposite directions perpendicular to, and at a higher level than, the aforementioned third line, in such a manner as to move across said third line when a box passes and back again when the next box passes, thus applying fourth glue strips along the top of said boxes's back end defined by said rear area of said blank, by means of a glue feeder mounted on said slide; and said tenth means including: a fixed guide located above said third line, constituted by a flat horizontal surface connected uninterruptedly to a curved surface, in the initial section of said guide, a concave surface of the curvature facing up and gradually sloping downwards in direction of flow of said boxes below it, said curved surface being designed to intercept said added area of said box's front end defined by said front area of the blank, in such a manner as to gradually fold said added area onto the tops of said strengthening projections, until the fold is completed by said horizontal surface; two longitudinal winged plates, hinged to said machine on either side of said guide, said winged plates rotating in opposite directions following trajectories contained in planes perpendicular to said third line, in closing direction, when said box is under said guide, in such a way as to fold downwards said added side areas of said added area, causing said added side areas to stick to corresponding top edges of said vertical strengthening projections smeared with third glue strips, and subsequently in opening direction; a third winged plate, hinged to the structure of said machine above the aforementioned third line, swinging in synchrony with said winged plates in opposite directions, first and second respectively, that are the same as and opposite to the direction of flow of said boxes, said third winged plate being designed, when it moves in said first direction, to strike with its free end said added side area of the aforementioned added area, thus folding the said added side area onto a corresponding top edge of said back end of said box.

* * * * *